United States Patent [19]

Richter et al.

[11] Patent Number: 4,465,021

[45] Date of Patent: Aug. 14, 1984

[54] STEAM GENERATOR WITH A MAIN BOILER AND A FLUIDIZED BED FURNACE

[75] Inventors: Robert Richter, Mannheim; Helmut Wiehn; Horst Lichtenberger, both of Oberhausen, all of Fed. Rep. of Germany

[73] Assignee: Deutsche Babcock Aktiengesellschaft, Oberhausen, Fed. Rep. of Germany

[21] Appl. No.: 399,020

[22] Filed: Jul. 16, 1982

[30] Foreign Application Priority Data

Aug. 22, 1981 [DE] Fed. Rep. of Germany ..... 3133298

[51] Int. Cl.[3] ..... F22B 1/02

[52] U.S. Cl. ..... 122/4 D; 165/104.16

[58] Field of Search ..... 122/4 D; 431/7, 170; 110/245; 165/104.16

[56] References Cited

U.S. PATENT DOCUMENTS 4,160,009 7/1979 Hamabe ..... 122/4 D X
4,184,455 1/1980 Talmud et al. ..... 122/4 D

FOREIGN PATENT DOCUMENTS 2018961 10/1979 United Kingdom ..... 122/4 D
1582534 1/1981 United Kingdom ..... 122/4 D

*Primary Examiner*—Edward G. Favors
*Attorney, Agent, or Firm*—Max Fogiel

[57] ABSTRACT

A steam generator in which a main boiler is provided and at least one fluidized bed furnace is connected with the main boiler and is operated independently of the furnace of the main boiler. The fluidized bed furnace is connected with the main boiler underneath the boiler funnel. The tubes of the boiler funnel are partially fanned out and form flue gas passages, through which the flue gas of the fluidized bed furnace flows into the combustion chamber of the main boiler.

9 Claims, 1 Drawing Figure

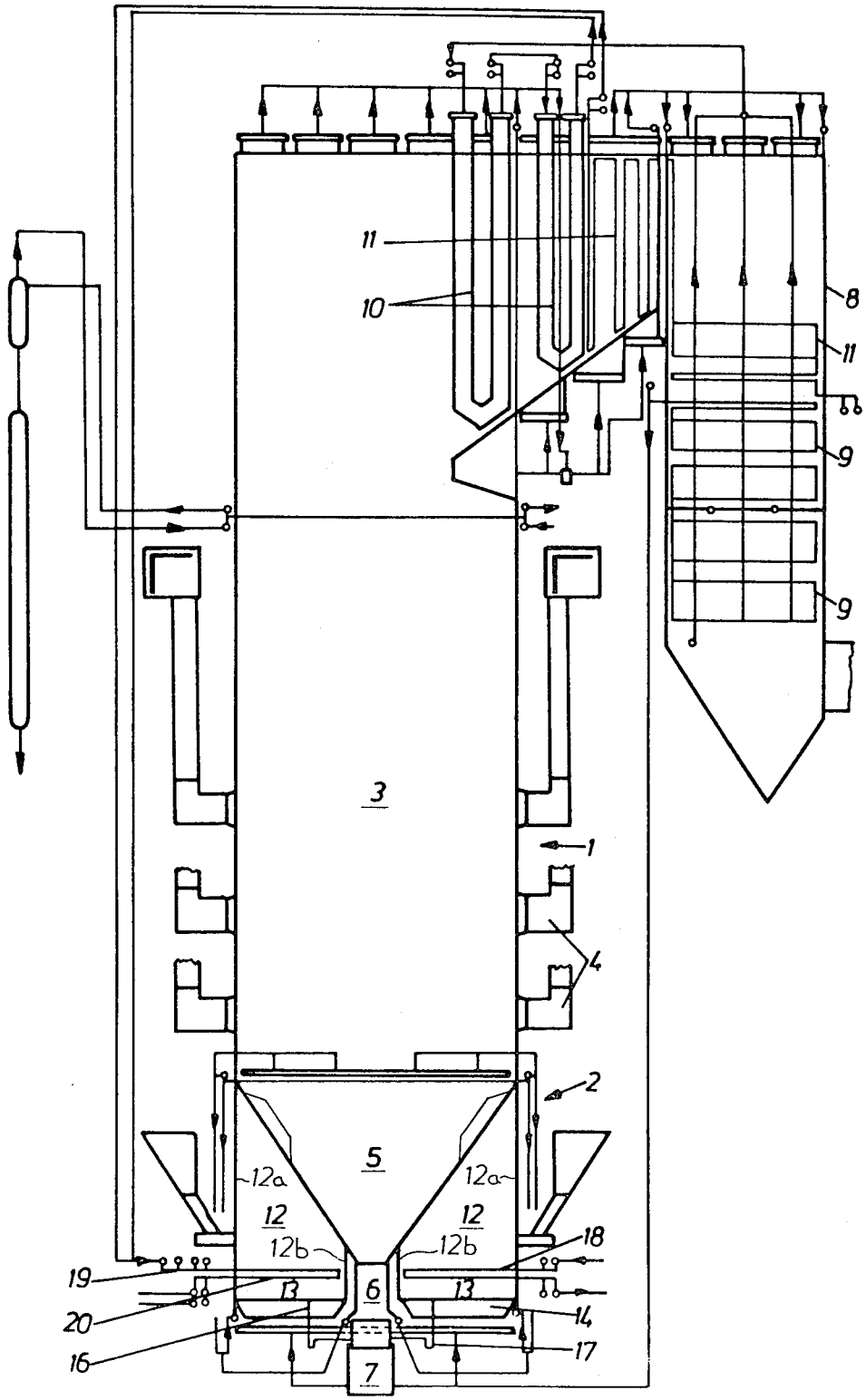
11
10
8
11
9
9
3
1
4
2
5
12a
12a
12
12
12b
12b
18
19
13
6
13
20
14
16
17
7

STEAM GENERATOR WITH A MAIN BOILER AND A FLUIDIZED BED FURNACE

BACKGROUND OF THE INVENTION

The present invention concerns a steam generator with a main boiler and at least one fluidized bed furnace connected at the flue gas side with the main boiler. The main boiler displays a combustion chamber which is constructed with burners, side walls and a bottom, is equipped with evaporator heating surfaces and which has feedwater preheaters, superheaters and in a given case reheat superheaters connected downstream thereof. Heating surfaces are arranged in the fluidized bed furnace.

Such a steam generator is known from British Patent GB-PS No. 1,582,534. Through the arrangement of the heating surfaces in the fluidized bed furnace, a higher heat transfer can be attained in the region heated by flue gas. In the known steam generator, however, the flue gases of the fluidized bed furnace are fed to the main boiler behind the combustion chamber so that they flow through the second flue gas train or convection train together with the combustion gases of the combustion chamber. Although the heat of the flue gases of the fluidized bed furnace is hereby utilized for the steam generation process, the flue gases do not, however, let themselves be used so favorably for the entire process as when they are fed to the combustion chamber for afterburning, and in the sense of a flue gas recirculation.

A plant, in which the flue gases of the fluidized bed furnace are fed into the combustion chamber of the main boiler, is described in the Journal "VGB Kraftwerkstechnik 59" (1979) pages 105 to 109. In this plant, a combined gas-steam process is carried out. In that case, the heating surfaces present in the fluidized bed furnace are so connected that exclusively the air fed to the gas turbine is heated up in them. The heating surfaces of the water-steam circuit are housed exclusively in the main boiler. Thereby, the disadvantage results that the advantages connected with the arrangement of water or steam heating surfaces in the fluidized bed furnace cannot be exploited by this plant.

SUMMARY OF THE INVENTION

The present invention has the object of improving a steam generator of the initially described kind, in such a manner, that a high performance and high steam temperatures can be attained without particular increase in the constructional effort and with minimum use of materials of highest quality.

This object is achieved according to the present invention, whereby the fluidized bed furnace is connected with the main boiler underneath the boiler bottom and, the tubes of the boiler bottom are fanned out for the formation of a flue gas passage.

Through the present invention, the advantages of both the described plants are obtained.

In the steam generator, according to the present invention, the fluidized bed furnace is built into the main boiler and is carried by the boiler walls. The entire heat output of the steam generator is divided up over the fluidized bed furnace and the main boiler, so that a higher performance can be housed on the same space. In that case, proven basic constructions, such as boiler and fluidized bed furnace, can be fallen back on, which are modified and connected one with the other according to the present invention. Through the redisposition of the final stages of the superheaters into the fluidized bed furnace arranged underneath the main boiler, and thereby into proximity of the turbine, the part of the hot steam duct, which must be produced from a material of highest quality, can be shortened so that the consumption of this expensive material can be reduced.

The flue gases of the fluidized bed are fed to the combustion chamber. The entrained unburned (fuel) from the fluidized bed is there combusted further and thereby effects an improvement in efficiency.

Beyond that, the flue gases of the fluidized bed act in the sense of a flue gas recirculation in the combustion chamber. The heat loading of the combustion chamber heating surfaces is made more uniform in that the heating surfaces of the boiler bottom are activated and the flame temperature in the burner plane is reduced. The reduction in the flame temperature beyond that, affects a suppression of the formation of nitric oxides.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

A schematic elevational view of a steam generator according to the present invention.

DESCRIPTION OF THE PREFERRED EMBODIMENTS

The illustrated steam generator consists of a main boiler 1 and one or more fluidized bed furnaces 2 connected with the main boiler 1. The main boiler 1 displays a combustion chamber 3, in which burners 4 are arranged in several planes one above the other. The burners 4 are to be operated with a powdered, liquid or gaseous fuel. In the case of main boilers fired with coal dust, to which the example of embodiment relates, the lower part of the combustion chamber is tapered with the formation of a boiler funnel 5. The boiler funnel 5 ends in an ash passage opening 6, which extends in longitudinal direction of the combustion chamber. An ash remover 7 is arranged underneath the ash passage opening. In the case of oil-fired or gas-fired main boilers 1, a closed horizontal boiler bottom is used in place of the boiler funnel 5.

A gas flue 8 adjoins the combustion chamber 3. The walls of the combustion chamber 3 and of the gas flue 8 are formed of tubes welded together in a gas-tight manner and connected as evaporator or superheater heating surfaces. Further heating surfaces, such as feedwater preheater 9, superheater 10 and in a given case reheat superheaters 11 are housed in the gas flue 8 and in the transition between the combustion chamber 3 and the gas flue 8.

The fluidized bed furnace 2 is operated independently of the burners 4 of the main boiler. The fluidized bed furnace consists, in the conventional known manner, of a fluidized bed combustion chamber 12, defined by walls **12*a* and 12*b*, with a fluidized bed 13, which is provided above an inflow bottom and to which air is conducted through an air box 14. The fuel is added to the combustion chamber 11 through a stoker 14 in the illustrated case. It can, however, also be fed into the fluidized bed 13 through bottom nozzles or conveying equipments. The walls of the fluidized bed combustion chamber 12** are formed of cooled tubes which are connected as feedwater preheaters or evaporator heating surfaces.

In the illustrated case, two fluidized bed furnaces 2 are provided, which are arranged on both sides of the ash passage opening 6. The fluidized bed furnaces 2 are connected with the main boiler 1 by the fluidized bed combustion chambers 12 suspended at the walls of the combustion chamber 3 of the main boiler 1. The fluidized bed combustion chambers 12 are, therefore, carried also by the boiler frame of the main boiler 1. In order to absorb the weight of the middle portions of the fluidized bed combustion chambers 12, the tubes of the boiler funnel 5 are constructed as tie rods.

The tubes of the boiler funnel 5 are fanned out, as known in the art, at least in the edge region and in this manner form a flue gas passage, through which the flue gases of the fluidized bed furnaces 2 flow into the combustion chamber 3.

A small proportion of ash from the combustion chamber 3 arises in the boiler funnel 5. The main quantity of this ash arising in the boiler funnel 5 issues out through the ash passage opening 6. A small proportion of this ash can also drop through the flue gas passages arranged in the edge region of the boiler funnel 5 into the fluidized bed combustion chamber 12 and is drawn off with the ash of the fluidized bed furnaces 2.

The fluidized bed combustion chambers 12 are provided with outlet tubes 16, through which the ash is drawn off. The outlet tubes 16 are provided with a siphon 17 and connected with the ash remover 7. Thereby, a common ash removal system is created for the main boiler 1 and the fluidized bed furnaces 2.

Heating surfaces 18, 19 and 20 are arranged in the fluidized bed 13 of the fluidized bed furnaces 2. The heating surfaces 8 of the fluidized bed furnace 2 illustrated to the right in the drawing is connected as a low pressure reheat superheater. The heating surface 19 of the fluidized bed furnace illustrated at the left, serves as final stage of the superheater and is connected downstream of the superheater 10 arranged in the transition of the main boiler 1. The heater surface 20 represents the final stage of the medium pressure reheat superheater and is connected with the exit and of the reheat superheater 11 arranged in the transition of the main boiler 1. The exit collectors of the heater surfaces 18, 19 and 20 of the fluidized bed furnaces 2 are connected with a turbine not illustrated. This turbine is arranged in the proximity and in the same plane as the fluidized bed furnaces 2 so that only short connecting ducts are required.

The heating surfaces 18, 19 and 20 arranged in the fluidized bed furnace 2 can also be connected in bypass. In this case, in case of a fault at the fluidized bed furnace 2, the steam generated in the main boiler can be conducted directly to the turbine.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. Steam generator with a main boiler and at least one fluidized bed furnace connected at flue gas side with the main boiler, comprising a combustion chamber having burners, side walls and a bottom, and evaporator heating surfaces, said burners being arranged in said side walls of said combustion chamber; feedwater preheaters, superheaters and reheat superheaters connected downstream of said combustion chamber; and heating surfaces arranged in the fluidized bed furnace; said fluidized bed furnace being connected with the main boiler underneath the boiler bottom, said boiler bottom having tubes fanned out for the formation of a flue gas passage, said fluidized bed furnace is suspended on the main boiler, said tubes of said boiler bottom comprising also tie rods.

2. Steam generator according to claim 1, wherein said tubes of said boiler bottom are fanned out only at an edge region.

3. Steam generator according to claim 1, wherein a plurality of fluidized bed surfaces are mounted symmetrically to the longitudinal direction of the main boiler.

4. Steam generator according to claim 1, wherein said boiler bottom comprises further an ash passage opening, an ash remover arranged below said opening, said fluidized bed furnaces being connected through siphon tubes with said ash remover.

5. Steam generator according to claim 1, wherein heating surfaces of final stages of the superheater are arranged in one of the fluidized bed furnaces.

6. Steam generator according to claim 1, wherein heating surfaces of final stages of the reheat superheater are arranged in one of the fluidized bed furnaces.

7. Steam generator according to claim 1, wherein heating surfaces of final stages of the superheater and the reheat superheater are arranged in one of the fluidized bed furnaces.

8. Steam generator according to claim 1, wherein a low pressure reheat superheater has an entire heating surface arranged in one of the fluidized bed furnaces.

9. Steam generator according to claim 1, wherein heating surfaces of the fluidized bed furnaces are connected in bypass.

* * * * *